US007682046B2

(12) United States Patent
Bartlett et al.

(10) Patent No.: US 7,682,046 B2
(45) Date of Patent: Mar. 23, 2010

(54) LIGHT FIXTURE WITH LAMP ADJUSTMENT ASSEMBLY

(75) Inventors: Paul James Bartlett, Newnan, GA (US); Chiu Hua Jung, Shenzhen (CN)

(73) Assignee: Cooper Technologies Company, Houston, TX (US)

( * ) Notice: Subject to any disclaimer, the term of this patent is extended or adjusted under 35 U.S.C. 154(b) by 114 days.

(21) Appl. No.: 11/929,082

(22) Filed: Oct. 30, 2007

(65) Prior Publication Data

US 2009/0109694 A1 Apr. 30, 2009

Related U.S. Application Data

(63) Continuation-in-part of application No. 11/928,540, filed on Oct. 30, 2007.

(51) Int. Cl.
*F21V 19/00* (2006.01)

(52) U.S. Cl. ..... 362/288; 362/188; 362/285; 362/289; 362/372

(58) Field of Classification Search ..... 362/188, 362/285, 288, 289, 372
See application file for complete search history.

(56) References Cited

U.S. PATENT DOCUMENTS

| | | | | |
|---|---|---|---|---|
| 999,860 | A | 8/1911 | Perry et. al. | |
| 1,083,530 | A | 1/1914 | Gallay | |
| 1,115,033 | A | 10/1914 | Stearns | |
| 2,802,094 | A | 8/1957 | Grosz | |
| 2,992,322 | A * | 7/1961 | Motter | 362/288 |
| 4,564,891 | A | 1/1986 | Daumuller et al. | |
| 4,688,154 | A | 8/1987 | Nilssen | |
| 5,017,327 | A | 5/1991 | Bamber | |
| 5,017,838 | A | 5/1991 | Nilssen | |
| 5,816,686 | A | 10/1998 | Wang et al. | |
| 6,227,884 | B1 | 5/2001 | Hierzer | |
| 6,716,042 | B2 | 4/2004 | Lin | |
| 6,981,783 | B2 * | 1/2006 | Kao | 362/285 |
| 7,038,380 | B2 | 5/2006 | Hsu | |
| 7,160,001 | B2 | 1/2007 | Bartlett | |
| D537,193 | S | 2/2007 | Lehman et al. | |
| D549,388 | S | 8/2007 | Lehman et al. | |
| 7,416,422 | B2 | 8/2008 | Lehman et al. | |
| 7,425,140 | B2 | 9/2008 | Lehman et al. | |

(Continued)

OTHER PUBLICATIONS

U.S. Appl. No. 11/929,540, filed Oct. 2007, Paul Bartlett et al.

*Primary Examiner*—Stephen F Husar
(74) *Attorney, Agent, or Firm*—King & Spalding LLP

(57) ABSTRACT

A lamp adjustment assembly for a light fixture includes a socket platform having a base and hollow neck. A socket mounts to the base. The interior of the hollow neck includes at least three spaced-apart cam followers. A cam having spiral grooves includes a first portion that fits at least partially within the interior of the hollow neck. The cam followers mate with the grooves. An adjustment knob is coupled to a second portion of the cam and rotatably coupled to a socket housing that at least partially encloses the lamp adjustment assembly. Alignment wings extend from the base of the socket platform and are sized to fit within slots in the interior of the socket housing. The slots prevent the socket platform from rotating and limit the linear range of motion of the socket platform. A spring applies force to the base and the adjustment knob.

20 Claims, 6 Drawing Sheets

U.S. PATENT DOCUMENTS

| | | | |
|---|---|---|---|
| 7,520,762 | B2 | 4/2009 | Lehman et al. |
| 2007/0153309 | A1 | 7/2007 | Sasanuma et al. |
| 2007/0153509 | A1 | 7/2007 | Lehman et al. |
| 2007/0153516 | A1 | 7/2007 | Lehman et al. |
| 2007/0153550 | A1 | 7/2007 | Lehman et al. |
| 2007/0167043 | A1 | 7/2007 | Lehman et al. |
| 2009/0109707 | A1 | 4/2009 | Lehman et al. |

* cited by examiner

LIGHT FIXTURE WITH LAMP ADJUSTMENT ASSEMBLY

RELATED APPLICATION

The present application is a continuation-in-part of U.S. patent application Ser. No. 11/928,540 filed on Oct. 30, 2007 and titled "Light Fixture with Removable Lamp Housing".

TECHNICAL FIELD

The subject matter disclosed here generally relates a precision lamp adjustment mechanism for a light fixture and, more particularly, to a focus mechanism for adjusting the light beam spread radiating from a light fixture.

BACKGROUND OF THE INVENTION

A light fixture is a device for producing, controlling, and distributing light. It is typically a complete unit consisting of one or more lamp, a socket or sockets for positioning the lamp(s) and for connecting the lamp(s) to a power supply, a covering to protect the lamp(s), optical devices for distributing the light, and mechanical components for supporting or attaching the light fixture.

"Track lighting" is a term that generally refers to a system that includes at least one such light fixture and a track or rail that is designed to support the light fixture and deliver electric power. For example, the track may be mounted at or near the ceiling surface, recessed into the ceiling, or mounted horizontally or vertically along a wall or other surface. Track lighting systems come in a variety of shapes, sizes, and configurations. Track light fixtures also come in many shapes and styles and may be designed for use with a wide variety of lamps including incandescent, halogen, metal-halide, and fluorescent. However, in the typical configuration, a track light fixture includes a housing that encloses the lamp, socket and related internal electrical and mechanical components. The housing is coupled to external mechanical components for attaching the light fixture to a track.

Optical control of track lighting system is typically accomplished by positioning the track light fixtures along the track and then aiming the positioned light fixtures at a particular target area. Often times, a light fixture will include one or more locking mechanism to lock the fixture in place once it is positioned and aimed. Other optical control techniques may rely upon reflectors, refractors, diffusers, shades, hoods, cowls, and other devices, which are either included within or mounted to the track light fixture.

"Photometric performance" is a term that broadly refers to the efficiency and effectiveness with which a luminaire delivers light to an intended target and is often described in terms of various light distribution characteristics of a luminaire. For example, a "luminous intensity distribution curve" may be used to represent the variation of luminous intensity in a plane through the light center of the luminaire. The term "beam spread" is also used to refer to the angle between two directions in a plane in which the intensity is equal to a certain percentage of the maximum beam intensity. When that intensity is 50% of the maximum intensity through the nominal beam centerline, then the term "beam angle" is also used.

Various mechanisms have been suggested for controlling beam spread and other photometric performance characteristics of track lights and other luminaires. According to "Marks' Standard Handbook for Mechanical Engineers," eighth edition, which is also incorporated by reference herein in its entirety, such mechanisms include, but are not limited to, linkages, cams, hoists, and/or elliptical trains. A "cam" is usually a plate or cylinder which communicates motion to a follower by means of its edge or a groove cut in its surface. However, other types of cam mechanisms are also known.

U.S. Pat. No. 7,160,001 to Bartlett et al., which is incorporated herein by reference in its entirety, describes a focus mechanism for a luminaire in which a mounting cup is axially translated relative to a stationary reflector to adjust the light beam spread of the luminaire. Although the focus mechanism of that patent is highly successful, more efficiently constructed focus mechanisms are possible.

Lamps in a track light fixture must typically be replaced or maintained at regular intervals, so as to keep the light fixture in working order. In most track light fixtures, however, accessing the lamps can be relatively difficult and/or time consuming. Often, a portion of the housing, such as a lens assembly, must be removed in order to access the interior of the housing. Also, unless the light fixture is moved out of its desired position, the housing itself may often obstruct the view of the socket. Thus, once the lamp replacement or maintenance is complete, the light fixture must be repositioned to direct light to the target location. This process is inefficient, particularly where a large number of lamps must be replaced or maintained.

SUMMARY OF THE INVENTION

The present invention provides an improved lamp adjustment assembly for a light fixture. The lamp adjustment assembly includes a socket platform having a base and a hollow neck. The base of the socket platform is configured for having a socket mounted thereto. The hollow neck of the platform may be substantially cylindrical. The interior of the hollow neck includes at least three spaced apart cam followers. The lamp adjustment assembly further includes a cam, which may be substantially cylindrical, having at least one spiral groove. A first portion of the cam fits at least partially within the interior of the hollow neck of the socket platform so that the cam followers mate with the at least one groove. An adjustment knob is coupled to a second portion of the cam and is also rotatably coupled to a socket housing. The socket housing at least partially encloses the lamp adjustment assembly and the socket.

At least two slots are positioned within the interior of the socket housing. Also, at least two alignment wings extend from the base of the socket platform. Each alignment wing is sized to fit within a corresponding one of the slots. The alignment wings and the corresponding slots prevent the socket platform from rotating within the socket housing as the cam and focus knob are rotated. The slots extend at least partially along the height of the socket housing and function to limit the linear range of motion of the socket platform. At least one of the slots may include a threaded hole for receiving a screw, which may be driven into the slot in order to further limit the linear range of motion of the socket platform.

The lamp adjustment assembly may further include a spring having a first end that fits over the hollow neck of the socket platform and abuts the underside of the base and having a second end that fits over the cam and abuts the adjustment knob. The spring applies force to each of the base and the adjustment knob. Rotation of the adjustment knob in a first direction causes the cam to rotate in the first direction, which causes the socket platform to travel in a first linear direction relative to the socket housing. Rotation of the adjustment knob in a second direction causes the cam to rotate in the second direction, which causes the socket platform to travel in a second linear direction relative to the socket housing.

A lamp housing may be provided for at least partially enclosing a lamp installed within the socket of the socket housing. The lamp housing includes a first end for emitting light from the lamp and a second end configured to be removably coupled to the socket housing. The second end of the lamp housing is preferably wider than the lamp, so as to allow the lamp housing to be removed from the socket housing without first removing the lamp from the socket.

These and other aspects, features and embodiments of the invention will become apparent to a person of ordinary skill in the art upon consideration of the following detailed description of illustrated embodiments exemplifying the best mode for carrying out the invention as presently perceived.

DETAILED DESCRIPTION OF EXEMPLARY EMBODIMENTS

The following description of exemplary embodiments of the invention refers to the attached drawings, in which like numerals indicate like elements throughout the several figures.

Figure 1:
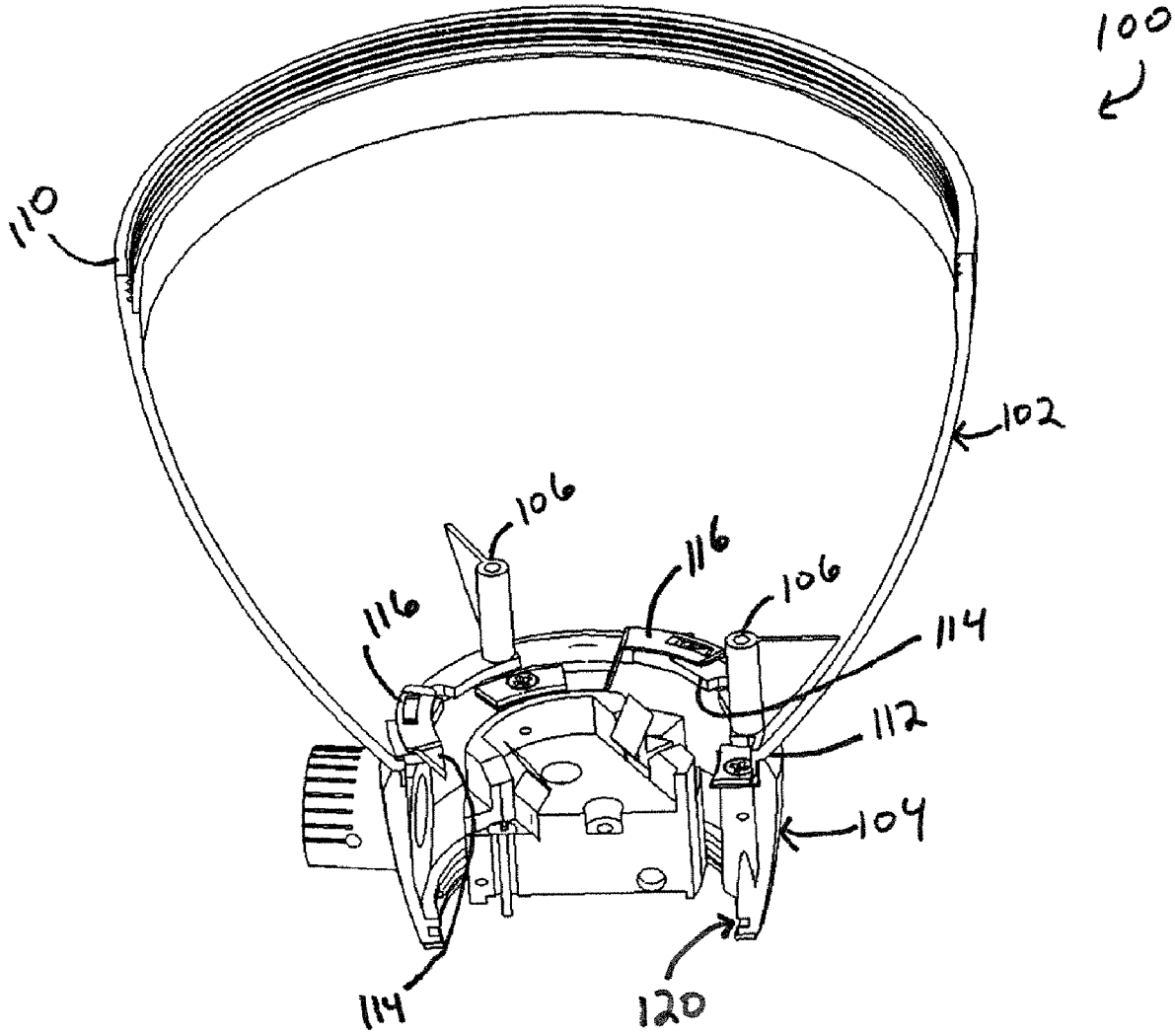
FIG. 1 is a perspective cross-sectional view of a removable lamp housing coupled to a socket housing, in accordance with certain exemplary embodiments of the present invention.

FIG. 1 is a perspective cross-sectional view of an exemplary light fixture 100, showing a removable lamp housing 102 coupled to a socket housing 104. As will be described in more detail below, the lamp housing 102 may be separated from the socket housing 104 by rotating the lamp housing 102 relative to the stationary socket housing 104. The lamp housing 102 may include mounting holes 106 for attaching a reflector, refractor, diffuser, or other component for controlling the light emitted from the lamp (not shown). A lens assembly may also be mounted within the lamp housing 102 or attached to a first end 110 of the lamp housing 102.

The lamp housing 102 includes a second end 112, which meets the socket housing 104 when the lamp housing 102 is coupled thereto. This second end 112 includes an opening that is preferably wider than the lamp (not shown) that is intended for use within the fixture, so that the lamp housing 102 may be removed from and re-coupled to the socket housing 104 without having to first remove the lamp. In certain embodiments, this second end 112 of the lamp housing 102 also includes one or more tabs 114. The tabs 114 may extend into or away from the opening in the second end 112 of the lamp housing 102.

Figure 2:
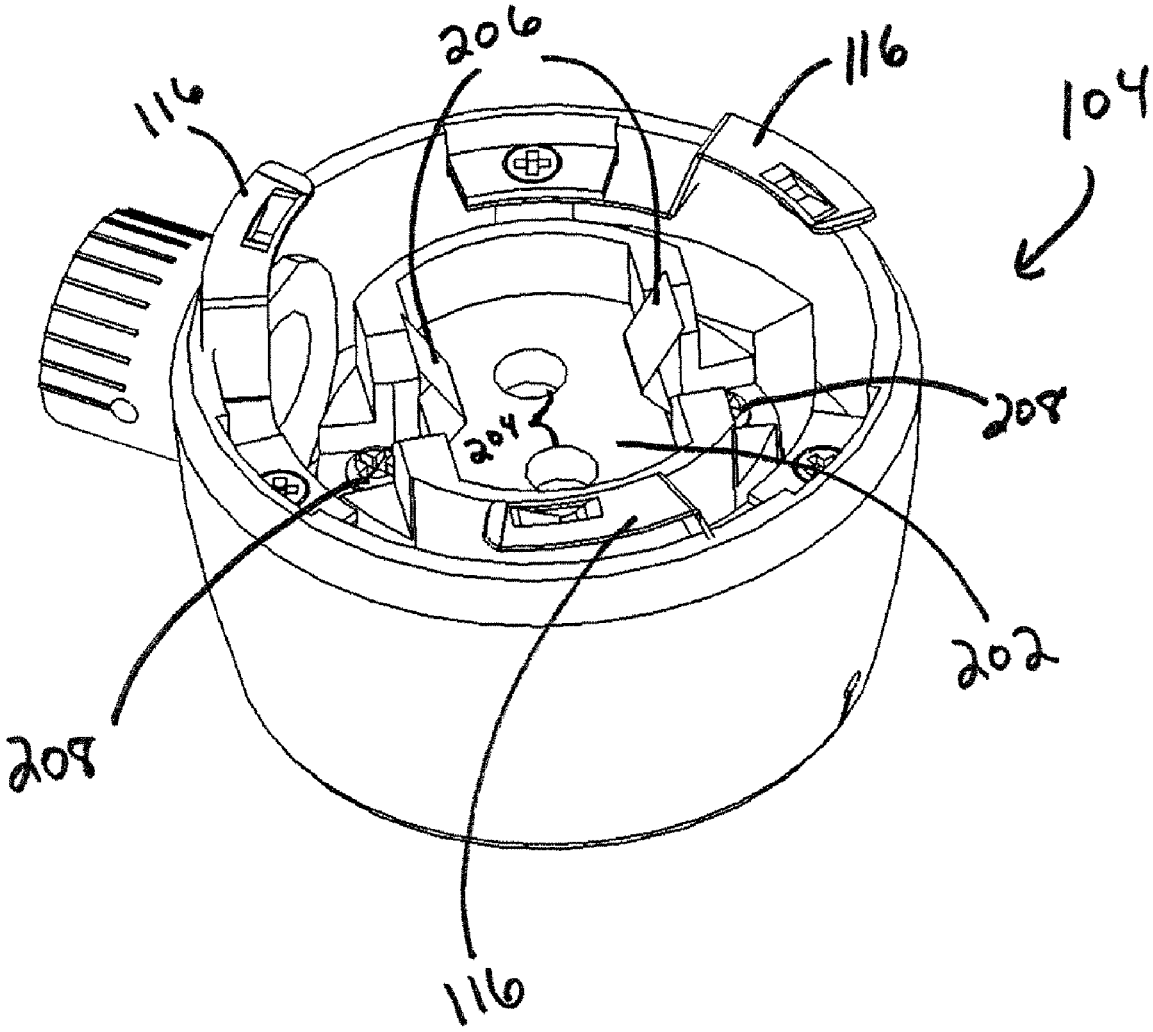
FIG. 2 is a perspective view of a socket housing, in accordance with certain exemplary embodiments of the present invention.
Figure 3:
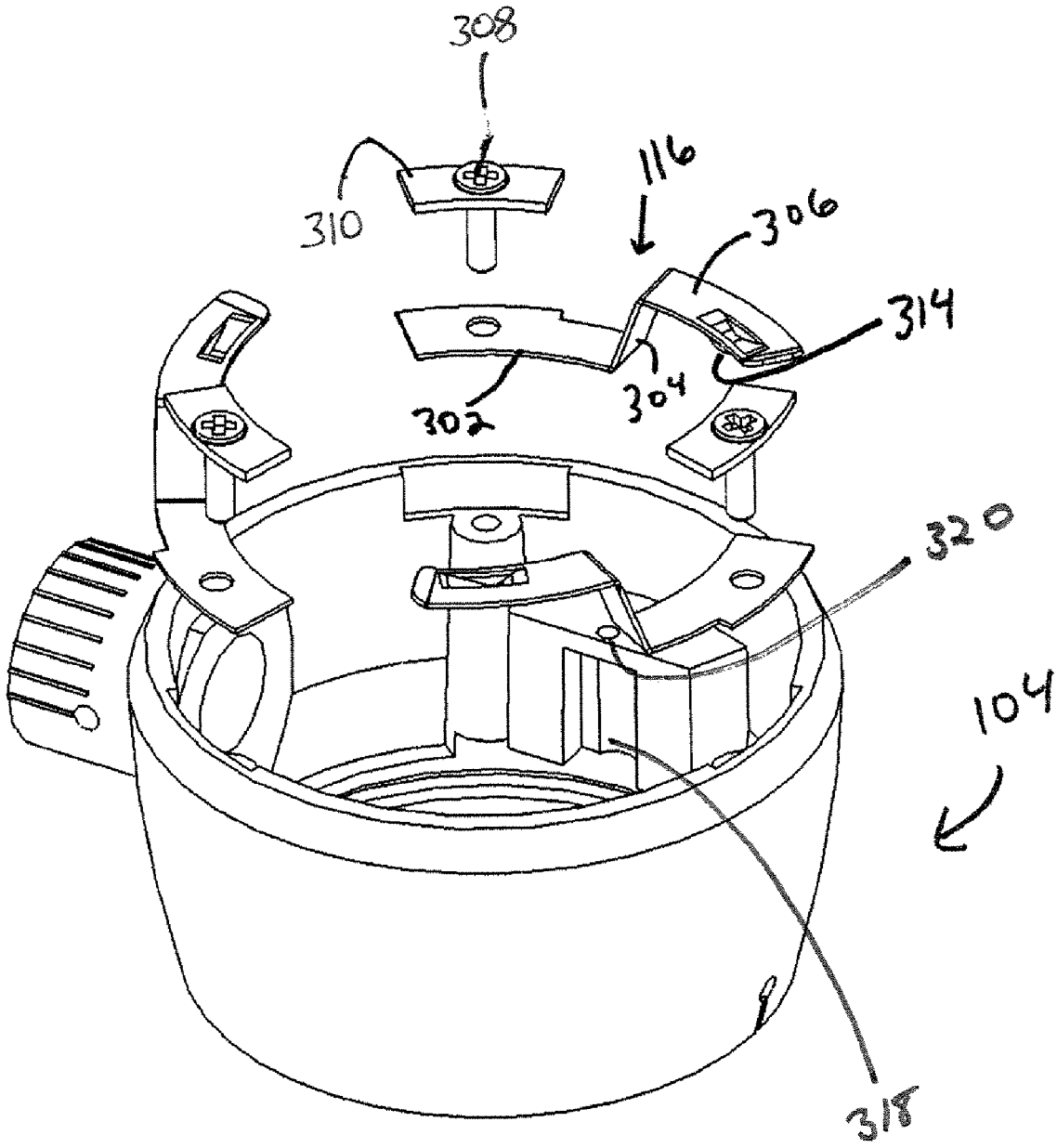
FIG. 3 is a perspective view of the exemplary socket housing shown in FIG. 2, including an exploded view of a locking arm assembly thereof.

The tabs 114 are configured to mate with corresponding locking arms 116 of the socket housing 104, as will be shown and described in greater detail with respect to FIGS. 2 and 3. The tabs 114 may be formed as part of the lamp housing 102 or may be attached to the lamp housing 102. The tabs 114 and the lamp housing 102 may each be made of metal (e.g., stainless steel, aluminum, etc.), plastic, a composite or any other suitable material that is sufficiently sturdy and resistant to heat produced by the lamp. In alternative embodiments, the tabs 114 of the lamp housing 102 may be replaced by hooks, latches or other suitable quick-release connectors and the locking arms 116 of the socket housing 104 may be replaced by corresponding connectors that mate with and secure the connectors of the lamp housing 102.

FIG. 2 is a perspective view of the exemplary socket housing 104 and FIG. 3 shows an exploded view of a locking arm 116 assembly thereof. The socket housing 104 includes a lamp socket 202 with insert holes 204 and stabilizing clamps 206 for accepting a lamp. The lamp socket 202 is coupled to the socket housing 104 with screws 208 or other connectors in a conventional manner. The socket housing 104 also includes a lamp adjustment assembly, which is shown in and described with respect to FIGS. 4-6. As previously mentioned, the socket housing 104 also includes one or more locking arms 116, configure to mate with and secure the tabs 114 of the lamp housing 102.

The locking arms 116 and the socket housing 104 may each be made of metal (e.g., stainless steel, aluminum, etc.), plastic, a composite or any other suitable material that is sufficiently sturdy and resistant to heat produced by the lamp. In certain embodiments, the lamp housing 102 includes three tabs 114 spaced along the second end 112 and the socket housing 104 includes three corresponding locking arms 116. In alternative embodiments, one or more tab 114/locking arm 116 interactions may be used to removably couple the lamp housing 102 to the socket housing 104.

In the illustrated embodiments, each locking arm 116 is formed or bent to have three sections: a lower section 302, a middle section 304 and an upper section 106. The lower section 302 and the upper section 306 lie generally parallel to the opening in the socket housing 104. The middle section 306 is angled relative to the lower section 302, so as to offset the lower section 302 and the upper section 306 in the vertical plane (i.e., above the socket housing 104, as oriented in FIGS. 2 and 3). The upper portion 306 of each locking arm 116 extends sufficiently above the socket housing 104 such that a corresponding tab 114 of the lamp housing 102 can fit thereunder, to thereby hold the lamp housing 102 securely to the socket housing 104.

The locking arms 116 may be formed as part of the socket housing 104 or may be attached to the lamp housing 104, as illustrated. For example, each locking 116 may be attached to the lamp housing 104 with a screw 308 and, optionally, a washer 310. The addition of a washer 310 adds further stability to the assembly. The screw 308 may be inserted through corresponding holes in the washer 310, the lower section 302 of the locking arm 116, and the socket housing 104. Other methods for attaching the locking arm 116 to the socket housing 104 are possible, such as the use of an adhesive or spot welding or other suitable mechanical connectors.

As should be apparent, the lamp housing 102 may be coupled to the socket housing 104 by placing the tabs 114 of the lamp housing 102 in juxtaposition with the corresponding locking arms 116 of the lamp housing 104 and rotating the lamp housing 102 until its tabs 114 slide under the corresponding locking arms 116. Conversely, the lamp housing 102 may be removed from the socket housing 104 by rotating the lamp housing 102 in the opposite direction (relative to the direction of rotation for coupling the lamp housing 102 to the socket housing 104), so as to separate the tabs 114 from the locking arms 116.

In certain embodiments, the underside of the upper portion 306 of each locking arm 116 may include a protrusion 314. The tabs 114 of the lamp housing 102 may have a ramped or sloped configuration, with the tallest edge thereof being closest to the first side 110 of the lamp housing 102 and the shortest edge thereof being closest to the second side 112 of the lamp housing 102. The tallest edge of each tab 114 may be designed to mate with or otherwise contact the protrusion 314 of the corresponding locking arm 116. In alternative embodiments, each tab 114 may be relatively flat, but include a protrusion for mating with or otherwise contacting the protrusion 314 of the corresponding locking arm 116.

In still other embodiments, each tab 114 may include a protrusion or indention for mating with or otherwise contacting a corresponding indention or protrusion on the corresponding locking arm 116. As will be readily appreciated by those of ordinary skill in the art, the corresponding protrusions, ramped edges and/or indentions of the tabs 114 and locking arms 116 will need to bypass each other when the lamp housing 102 is rotated into or out of connection with the socket housing 104, thus requiring the application of a certain amount of additional force. Accordingly, the corresponding protrusions, ramped edges and/or indentions of the tabs 114 and locking arms 116 provide for a more secure connection between the lamp housing 102 and the socket housing 104. In alternative embodiments, other means may be employed to secure the connection between the lamp housing 102 and the socket housing 104, including but not limited to a latching mechanism, a locking screw or pin, a snap, or any other suitable type of fastener or connector.

In still other embodiments, other mechanisms may be used to removably attach the lamp housing 102 to the socket housing 104. For example, the lamp housing 102 may be secured to the socket housing 104 using corresponding pins and slots, latching mechanisms, threads and grooves, etc. The ability to remove the entire lamp housing 102 from the socket housing 104 provides a clear and unobstructed view of the socket 202, which makes for easier installation of a lamp. With a clear view of the socket 202 from any angle, an installer is less likely to have to change the position or alignment of the light fixture when installing a lamp.

Figure 4:
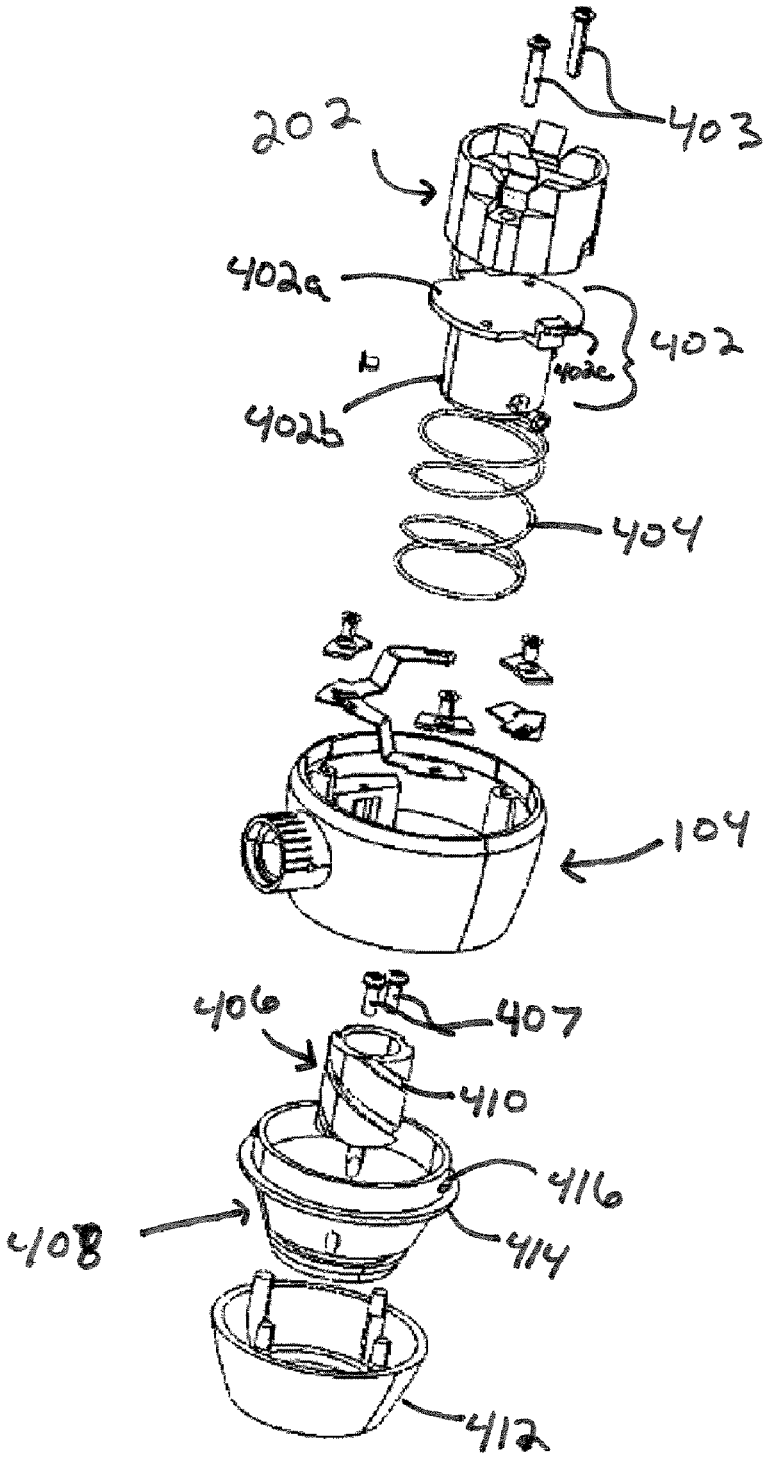
FIG. 4 is an exploded perspective view of the focus adjustment assembly for the luminaire shown in FIG. 1.

FIG. 4 is an exploded perspective view of the exemplary socket housing 104 and its included lamp adjustment assembly. The lamp adjustment assembly functions to adjust the light beam spread emanating from the light fixture by axial movement of the socket 202 into and out of the socket housing 104 relative to the lamp housing 102. The lamp adjustment assembly includes a socket platform 402, a spring 404, a cam 406 and an adjustment knob 408.

The socket platform 402 supports the socket 202. In the illustrated embodiment, the socket platform 402 comprises a substantially flat base 402*a* and a hollow cylindrical neck 402*b*. The socket 202 may be attached to the base 402*a* using screws 403 or other suitable attachment means. One end of the spring 404 is wide enough to fit over the neck 402*b* of the socket platform 202, but not the base 402*a*. The other end of the spring 404 is wide enough to fit over the cam 406. Accordingly, when the lamp adjustment assembly is assembled, one end of the spring 404 abuts and applies force to the base 402*a* of the socket platform 202 and the other end of the spring abuts and applies force to the interior of the adjustment knob 408.

Figure 5:
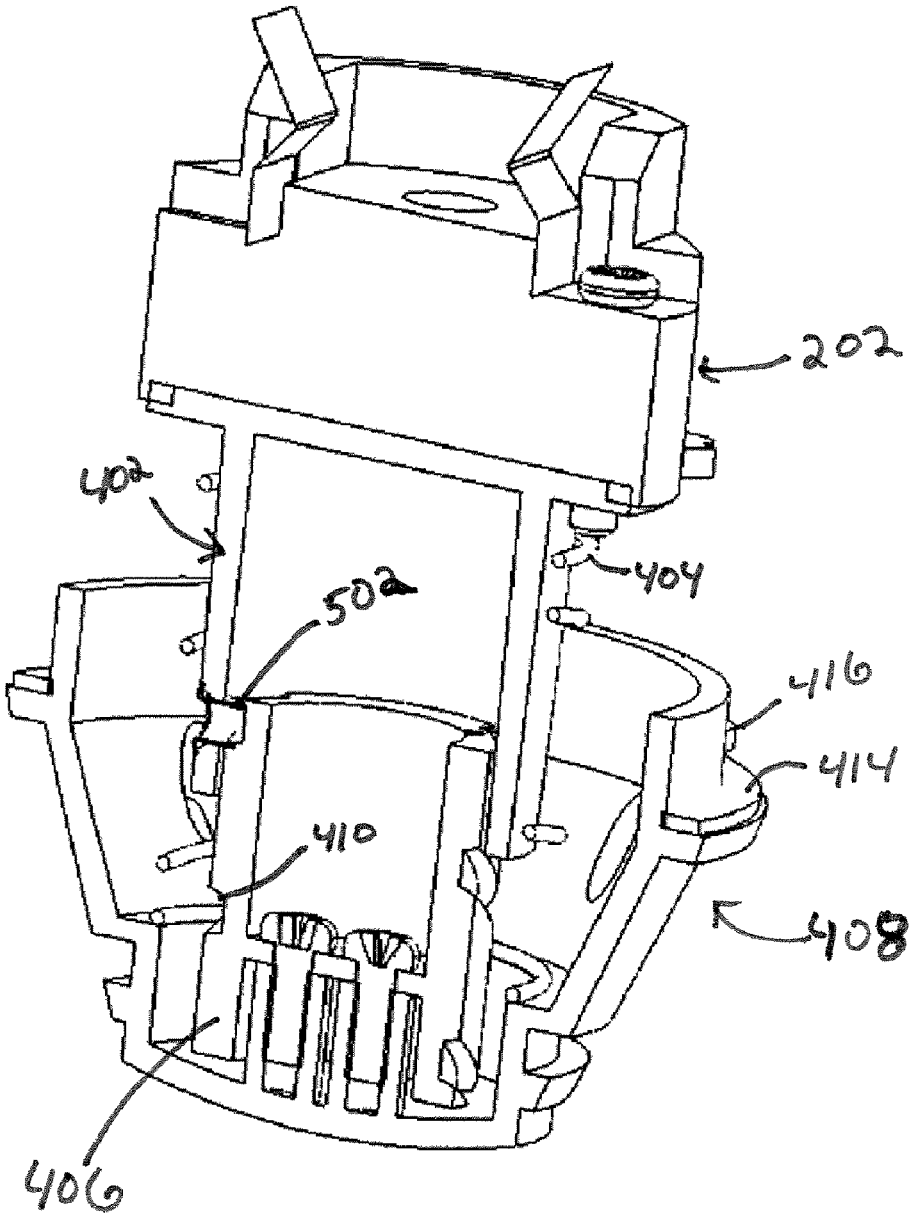
FIG. 5 is a cut out perspective of the lamp holder-lamp socket engaged with the focus knob so that the lamp holder-lamp socket is in an extended state.
Figure 6:
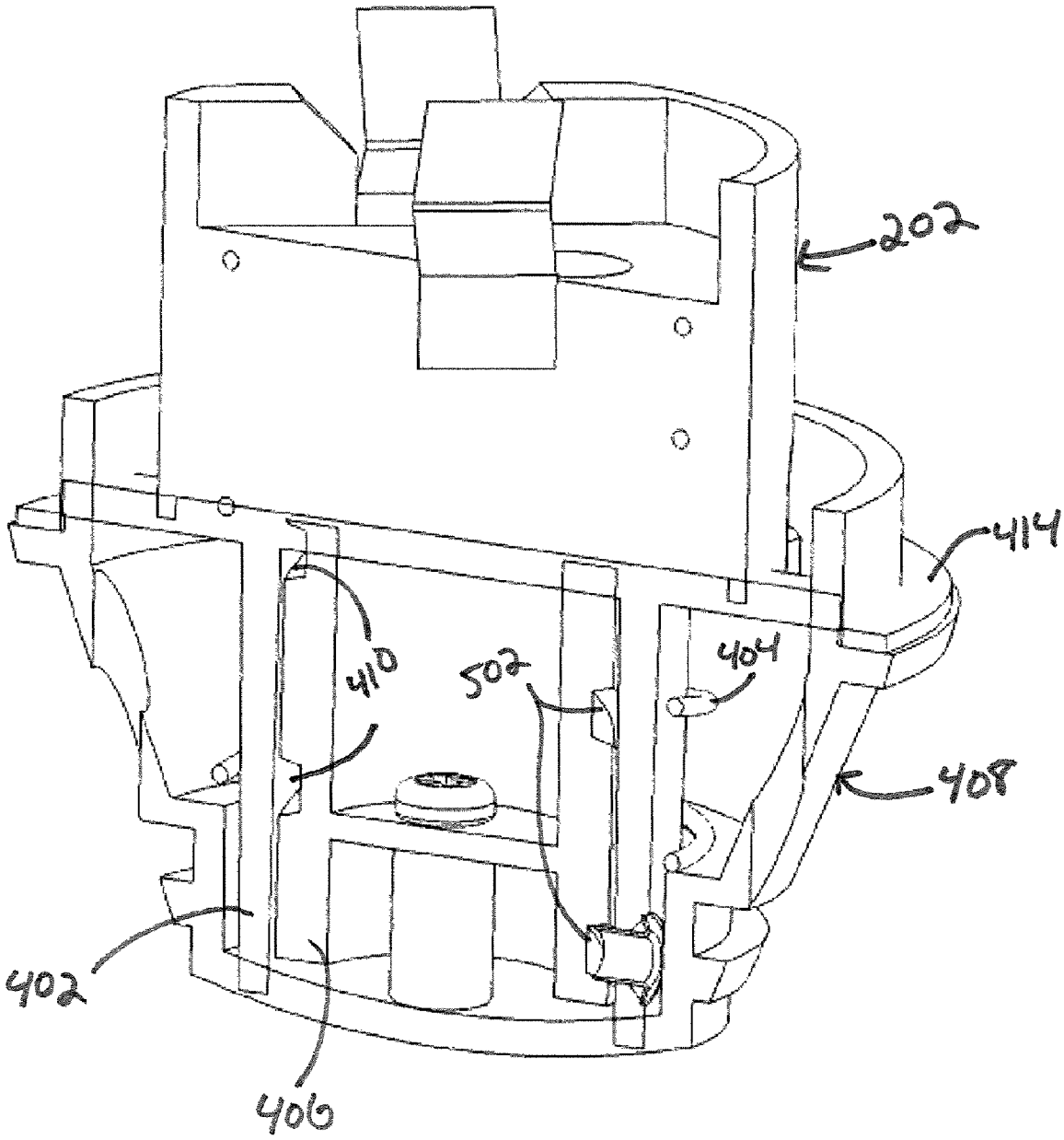
FIG. 6 is a cut out perspective of the lamp holder-lamp socket engaged with the focus knob so that the lamp holder-lamp socket is in a retracted state.

In certain embodiments, the interior of the hollow cylindrical neck 402*b* of the socket platform 402 includes a plurality of spaced-apart protrusions (shown in FIGS. 5 and 6), which mate with grooves 410 that spiral around the surface of the cam 406 and function as cam followers 502 (see FIGS. 5 and 6). Accordingly, a portion of the cam 406 is sized to fit at least partially within the interior of the hollow cylindrical neck 402*b* of the socket platform 402. another portion of the cam 406 is attached to the focus knob 408 using one or more screws 407 or other suitable attachment means. In certain embodiments, the cam 406 is intended to be interchangeable with other cams having different physical characteristics, so as to provide a modified light beam spread adjustment options. For example, the cam 406 may be interchanged with another cam having a alternative length and/or spiral grooves with an alternative pitch of curvature. The knob 408 may optionally be covered with a rubber or plastic finish 412 in order to provide the user with additional tactile control.

The adjustment knob includes a lip 414 or other surface that contacts an edge of the socket housing 104 when the lamp adjustment assembly is assembled. The adjustment knob 408 shown in FIG. 4 further includes two or more protrusions 416 positioned slightly above (relatively speaking) the lip 414 and sized to fit into a corresponding slots 120 (see FIG. 1) in the edge of the socket housing 104. The protrusions 416 and the corresponding slot function to rotatably secure the adjustment knob 406 to the socket housing 104 when the lamp adjustment mechanism is assembled. In alternative embodiments, other suitable means may be employed to rotatably secure the adjustment knob 406 to the socket housing 104.

As will be appreciated, when the lamp adjustment assembly is assembled, turning the focus knob 408 in one direction will cause the cam 406 to rotate in that same direction. The cam 406 will be positioned at least partially within the hollow neck 402*b* of the socket platform 402, such that the cam followers 502 (see FIGS. 5 and 6) within the hollow neck 402*b* mate with the grooves 410 of the cam 406. Thus, rotation of the cam 406 will cause the cam followers 502 to interact with the grooves 410, which will translate into linear motion of the socket platform 402. The socket platform 402 will travel in a first linear direction (either into or out of the socket housing 104) when the adjustment knob 408 is turned in one direction and will travel in a second direction when the adjustment knob 408 is turned in the opposite direction.

As shown in FIG. 4, alignment wings 402*c* may extend from substantially opposite sides of the base 402*a* of the socket platform 402. These alignment wings are sized to fit into corresponding slots 318 (see FIG. 3) within the socket housing 104. The slots 318 extend only partially along the height of the socket housing 104, stopping before the upper edge of the socket housing 104. Accordingly, the alignment wings 402*c* and corresponding slots 318 function to properly align the socket platform 402 (and the mounted socket 202) within the socket housing and to limit the linear range of motion of the socket platform 402. The alignment wings 402*c* and corresponding slots 318 also function to stabilizes the socket platform 402 and prevent the socket platform 402 from rotating within the socket housing 104 as the cam 406 and focus knob 408 are turned. In certain embodiments, the top end of at least one of the slots 318 includes a threaded hole 320, through which a screw (not shown) can be driven to a desired depth for further limiting the linear range of motion of the socket platform 402.

FIG. 5 is a cut out perspective of the lamp adjustment assembly, showing the socket platform 402 in an extended state. In this extended state the socket platform 402 is extended away from the cam 406 (and out of the socket housing 104). Accordingly, when the lamp housing 102 is attached to the socket housing 104 and the socket platform 402 is in the extended state, a lamp installed within the socket 202 will be extended into the lamp housing 102 (i.e., will travel in a linear direction towards the first end 110 of the lamp housing 102). FIG. 6 is a cut out perspective of the lamp adjustment assembly, showing the socket platform 402 in a retracted state. In this retracted state the socket platform 402 is retracted over the cam 406 (and into the socket housing 104). Accordingly, when the lamp housing 102 is attached to the socket housing 104 and the socket platform 402 is in the retracted state, a lamp installed within the socket 202 will be retracted into the lamp housing 102 (i.e., will travel in a linear direction towards the second end 112 of the lamp housing 102).

FIGS. 5 and 6 show a more detailed view of the cam followers 502 protruding from the interior of the hollow neck 402*b* of the socket platform 402. In certain embodiments, three cam followers 502 are substantially equally-spaced around the interior of the hollow neck 402*b*, so as to provide stability as the socket platform travels in the linear direction. It will be recognized, however, that the more or fewer cam followers may be employed in alternative embodiments. Furthermore, those skilled in the art will appreciate that the cam 406 can be configured with one or more grooves 410, which spiral around its surface. It will also be appreciated that the components of the lamp adjustment assembly may be constructed from any materials suitable for use in a light fixture, including metal, plastic, composites and/or any combination thereof.

The pitch of the groove(s) 410 that spiral around the cam 406 can be selected such that a particular turn angle for the adjustment knob 408 will result in a maximum linear range of motion for the socket platform 402. For example, in certain embodiments the pitch of the groove(s) 410 can be selected such that rotation of the adjustment knob 410 of between about 45° and about 360° will results in the maximum linear movement of the socket platform 402. In another embodiments, the pitch of the groove(s) 410 can be selected such that rotation of the adjustment knob 410 of between about 90° and about 180° corresponds with the maximum linear movement of the socket platform 402. In yet another embodiment, the pitch of the groove(s) 410 can be selected such that rotation of the adjustment knob 410 of about 90° results in the maximum linear movement of the socket platform 402.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of the present disclosure, without departing from the spirit and scope of the invention defined in the following claims, the scope of which is to be accorded the broadest interpretation so as to encompass such modifications and equivalent structures.

We claim:

1. A lamp adjustment assembly for a light fixture, comprising:

a socket platform comprising a base and a hollow neck, wherein the base has a socket mounted thereto and wherein the interior of the hollow neck includes at least three spaced apart cam followers;

a cam having at least one spiral groove, wherein a first portion of the cam fits at least partially within the interior of the hollow neck of the socket platform so that the cam followers mate with the at least one groove;

an adjustment knob coupled to a second portion of the cam and rotatably coupled to a socket housing, wherein the socket housing at least partially encloses the lamp adjustment assembly; and a spring having a first end that fits over the hollow neck of the socket platform and abuts the underside of the base and having a second end that fits over the cam and abuts the adjustment knob, wherein the spring applies a first force in a first direction to the base and a second force in a second direction to the adjustment knob, wherein the first direction and second direction are different.

2. The lamp adjustment assembly of claim 1, wherein rotation of the adjustment knob in a first direction causes the cam to rotate in said first direction, causing the socket platform to travel in a first linear direction relative to the socket housing; and wherein rotation of the adjustment knob in a second direction causes the cam to rotate in said second direction, causing the socket platform to travel in a second linear direction relative to the socket housing.

3. The lamp adjustment assembly of claim 1, wherein the hollow neck of the socket platform is substantially cylindrical.

4. The lamp adjustment assembly of claim 1, wherein the cam is substantially cylindrical.

5. The lamp adjustment assembly of claim 1, further comprising:

at least two slots positioned within the interior of the socket housing;

at least two alignment wings extending from the base of the socket platform, each alignment wing sized to fit within a corresponding one of the slots; and wherein the alignment wings and the corresponding slots prevent the socket platform from rotating within the socket housing as the cam and focus knob are rotated.

6. The lamp adjustment assembly of claim 5, wherein the slots extends only partially along the height of the socket housing; and wherein the alignment wings and the corresponding slots limit the linear range of motion of the socket platform.

7. The lamp adjustment assembly of claim 5, wherein at least one of the slots includes a threaded hole for receiving a screw; and wherein the screw may be driven into the slot in order to limit the linear range of motion of the socket platform.

8. The lamp adjustment assembly of claim 1, further comprising a lamp housing for at least partially enclosing a lamp installed within the socket, said lamp housing including a first end for emitting light from the lamp and a second end removably coupled to the socket housing; and wherein the second end of the lamp housing is wider than the lamp so as to allow the lamp housing to be removed from the socket housing without first removing the lamp from the socket.

9. A lamp adjustment assembly for a light fixture, the lamp adjustment assembly, comprising:

a socket platform comprising a base and a hollow neck, wherein the base has a socket mounted thereto and wherein the interior of the hollow neck includes at least three spaced apart cam followers;

a cam having a plurality of spiral groove, wherein a first portion of the cam fits at least partially within the interior of the hollow neck of the socket platform so that the cam followers mate with the grooves;

an adjustment knob coupled to a second portion of the cam and rotatably coupled to a socket housing, wherein the socket housing at least partially encloses the lamp adjustment assembly;

at least two slots positioned within the interior of the socket housing and extending at least partially along the height of the socket housing; and at least two alignment wings extending from the base of the socket platform, wherein each alignment wing is sized to fit within a corresponding one of the slots so that the alignment wings and the corresponding slots limit the linear range of motion of the socket platform.

10. The lamp adjustment assembly of claim 9, further comprising a spring having a first end that fits over the hollow neck of the socket platform and abuts the underside of the base and having a second end that fits over the cam and abuts the adjustment knob, wherein the spring applies force to each of the base and the adjustment knob.

11. The lamp adjustment assembly of claim 9, wherein the alignment wings and the corresponding slots further prevent the socket platform from rotating within the socket housing as the cam and focus knob are rotated.

12. The lamp adjustment assembly of claim 9, wherein rotation of the adjustment knob in a first direction causes the cam to rotate in said first direction, which causes the socket platform to travel in a first linear direction relative to the socket housing; and wherein rotation of the adjustment knob in a second direction causes the cam to rotate in said second direction, which causes the socket platform to travel in a second linear direction relative to the socket housing.

13. The lamp adjustment assembly of claim 9, wherein at least one of the slots includes a threaded hole for receiving a screw; and wherein the screw may be driven into the slot in order to further limit the linear range of motion of the socket platform.

14. A light fixture having an improved lamp adjustment assembly, comprising:

a socket housing for at least partially enclosing a socket;

a lamp housing for at least partially enclosing a lamp installed within the socket, said lamp housing including a first end for emitting light from the lamp and a second end removably coupled to the socket housing, wherein the second end of the lamp housing is wider than the lamp so as to allow the lamp housing to be removed from the socket housing without first removing the lamp from the socket; and a lamp adjustment assembly comprising:

a socket platform comprising a base and a hollow neck, wherein the socket is mounted to the base and wherein the interior of the hollow neck includes at least three spaced apart cam followers, a cam having at least one spiral groove, wherein a first portion of the cam fits at least partially within the interior of the hollow neck of the socket platform so that the cam followers mate with the at least one groove, an adjustment knob coupled to a second portion of the cam and rotatably coupled to the socket housing, at least two slots positioned within the interior of the socket housing and extending at least partially along the height of the socket housing, and at least two alignment wings extending from the base of the socket platform, wherein each alignment wing is sized to fit within a corresponding one of the slots so that the alignment wings and the corresponding slots limit the linear range of motion of the socket platform.

15. The lamp adjustment assembly of claim 14, further comprising a spring having a first end that fits over the hollow neck of the socket platform and abuts the underside of the base and having a second end that fits over the cam and abuts the adjustment knob, wherein the spring applies force to each of the base and the adjustment knob.

16. The lamp adjustment assembly of claim 14, wherein the alignment wings and the corresponding slots further prevent the socket platform from rotating within the socket housing as the cam and focus knob are rotated.

17. The lamp adjustment assembly of claim 14, wherein rotation of the adjustment knob in a first direction causes the cam to rotate in said first direction, which causes the socket platform to travel in a first linear direction relative to the socket housing; and wherein rotation of the adjustment knob in a second direction causes the cam to rotate in said second direction, which causes the socket platform to travel in a second linear direction relative to the socket housing.

18. The lamp adjustment assembly of claim 14, wherein at least one of the slots includes a threaded hole for receiving a screw; and wherein the screw may be driven into the slot in order to further limit the linear range of motion of the socket platform.

19. A lamp adjustment assembly for a light fixture, comprising:

a socket platform comprising a base and a neck, wherein the base has a socket mounted thereto and wherein the interior of the neck includes a cam follower;

a cam having at least one spiral groove, wherein a first portion of the cam fits at least partially within the interior of the neck of the socket platform;

an adjustment knob coupled to a second portion of the cam and rotatably coupled to a socket housing, wherein the socket housing at least partially encloses the lamp adjustment assembly;

at least two slots positioned within an interior of the socket housing;

at least two alignment wings extending from the base of the socket platform, each alignment wing sized to fit within a corresponding one of the slots; and wherein the alignment wings and the corresponding slots prevent the socket platform from rotating within the socket housing as the cam and adjustment knob are rotated.

20. The lamp adjustment assembly of claim 19, wherein the slots extends only partially along the height of the socket housing; and wherein the alignment wings and the corresponding slots limit the linear range of motion of the socket platform.

* * * * *